US007168689B2

(12) United States Patent
Giralt

(10) Patent No.: US 7,168,689 B2
(45) **Date of Patent: *Jan. 30, 2007**

(54) APPARATUS FOR PEDESTRIAN RAILING WITH SNAP-IN SPACER AND METHOD OF MAKING

(76) Inventor: Pedro P. Giralt, 12260 SW. 94th St., Miami, FL (US) 33186

( * ) Notice: Subject to any disclaimer, the term of this patent is extended or adjusted under 35 U.S.C. 154(b) by 144 days.

This patent is subject to a terminal disclaimer.

(21) Appl. No.: 10/904,256

(22) Filed: Nov. 1, 2004

(65) Prior Publication Data

US 2005/0051762 A1 Mar. 10, 2005

Related U.S. Application Data

(63) Continuation-in-part of application No. 10/064,449, filed on Jul. 16, 2002, now Pat. No. 6,811,146.

(51) Int. Cl.
*E04H 17/14* (2006.01)

(52) U.S. Cl. ..... 256/59; 256/19; 256/21; 256/65.01; 256/70

(58) Field of Classification Search ..... 256/19, 256/21, 59, 65.01, 65.02, 70, 22
See application file for complete search history.

(56) References Cited

U.S. PATENT DOCUMENTS 2,590,929 A 4/1952 Bush
2,654,579 A * 10/1953 Cremens ..... 256/21
3,083,951 A * 4/1963 Huret ..... 256/65.08
3,522,933 A * 8/1970 Braun ..... 256/65.02
3,924,834 A * 12/1975 Young ..... 256/59
4,346,872 A 8/1982 Tornya
4,586,697 A 5/1986 Tornya
4,809,955 A * 3/1989 Veilleux ..... 256/65.02
5,200,240 A 4/1993 Baker
5,649,688 A 7/1997 Baker
6,029,954 A 2/2000 Murdaca
6,041,486 A 3/2000 Forbis
6,811,146 B1 * 11/2004 Giralt ..... 256/65.01

* cited by examiner

*Primary Examiner*—Daniel P. Stodola
*Assistant Examiner*—Michael P. Ferguson
(74) *Attorney, Agent, or Firm*—Malin, Haley & DiMaggio, P.A.

(57) ABSTRACT

A sturdy aluminum pedestrian and bicyclist safety railing that reduces the amount of welding required during construction, comprising top and bottom rigid bars, each having a longitudinal, radially extending exterior passage and a plurality of aluminum pickets mounted within said bar top and bottom channels and held apart by a plurality of spacer plugs that interlock and snap snugly into each top and bottom bar channel and act as spacers to separate the pickets. The top and bottom bars may be welded together at each end of the railing to hold the entire unit together, retaining the plurality of rigid pickets that are substantially perpendicular (or inclined) to the top and bottom bars. The pickets are supported in the top and bottom bar channels without welding for increased strength and reduced cost of construction.

4 Claims, 4 Drawing Sheets

APPARATUS FOR PEDESTRIAN RAILING WITH SNAP-IN SPACER AND METHOD OF MAKING

FIELD OF THE INVENTION

This invention relates generally to a pedestrian railing used as a barrier or guard to protect pedestrians and bicyclists, and specifically, to an aluminum picket railing and the method of construction that reduces production costs significantly, while increasing structural strength.

DESCRIPTION OF RELATED ART

Guard railings are used near public conveyances such as walkways and bicycle paths to protect pedestrian traffic and cyclists for safety purposes. Although there are many variations in the construction of barriers, one type of guard railing uses a plurality of vertical, spaced apart aluminum pickets that are welded at top and bottom to horizontal or inclined bars. Metal posts are connected at spaced intervals that anchor the guard railing to the ground.

The disadvantages of welding numerous vertical aluminum pickets (at both ends) to top and bottom horizontal or inclined bars are loss of material strength and its expense. Although welding certainly provides very rigid construction and prevents removal or separation of the pickets from the railing itself, welding does weaken aluminum within one inch of the weld joint and is very costly and time consuming at the time of construction. The choice of aluminum is because of its ability to withstand harsh outdoor environments without rusting or severe oxidation. Aluminum is a difficult metal to weld.

The prior art shows a variety of different types of railing constructions. U.S. Pat. No. 4,346,872, issued Aug. 31, 1982 shows a balustrade construction that employs screw fasteners in construction. U.S. Pat. No. 2,590,929 issued Apr. 1, 1952 shows a railing that is pre-fabricated. U.S. Pat. No. 5,649,688 issued Jul. 22, 1997 shows railings with continuous spacers. U.S. Pat. No. 5,200,240 issued Apr. 6, 1993 shows an aluminum railing apparatus that uses screw fasteners. U.S. Pat. No. 4,586,697, issued May 6, 1986 shows another balustrade construction from extruded aluminum. U.S. Pat. No. 6,029,954 issued Feb. 29, 2000 shows a railing assembly that utilizes screw fasteners for construction. U.S. Pat. No. 6,041,486 issued Mar. 28, 2000 shows a method of assembling a fence.

When used by government for pedestrian walkways or bicycle paths, the barrier or guard railing should be rigidly constructed for use not only in protecting pedestrian traffic on walkways or cyclists on pathways but also to prevent theft or damage by people trying to deliberately damage public property. Thus, it is important that the railing be of a rigid, permanent type construction that cannot be readily disassembled, while at the same time being of reduced cost and complexity. This is especially true in the public arena where there is a requirement for large numbers of pedestrian and bicycle railings.

The present invention provides an improved pedestrian railing and method of construction that includes a rigid structure and method of manufacture that greatly reduces construction costs without reducing strength or rigidity of the entire structure. The improved pedestrian railing and method of construction is also easier to install and allows for replacement of pickets without the need for a welder.

SUMMARY OF THE INVENTION

A pedestrian railing and the method of construction comprising top and bottom parallel horizontal or inclined bars that each include a recessed, specially configured channel, disposed continuously along a predetermined segment of the railing bar exterior surface facing or projecting outwardly substantially radially. Each of the railing bars (top and bottom) has the same specially configured channel, viewed in cross-section.

Each pedestrian railing top and bottom bar external channel that protrudes from a peripheral section is substantially u-shaped in cross section. The channel walls parallel sides have coplanar, perpendicular, inwardly directed tabs, mid-length, separated at their ends by a space. The coplanar tabs divide the bar channel into two separate passageways. The railing bar channel is sized in width to receive (snugly) the end portion of a rectangular picket that fits into the recessed railing bar channel portions between the channel side walls. When the picket is in place, each picket end engages each bar channel and, abuts vertically the channel tabs that are used for holding each vertical picket in position in the vertical direction between top and bottom railing bars. The end face of each rectangular picket may be formed or cut at a ninety degree angle to the longitudinal axis of the picket for railings that are substantially positioned horizontally on flat ground but may be cut at an angle when used with top and bottom bars in a railing that is disposed inclined on a hill wherein the pickets are at relatively acute angles between the top and bottom rails. The end face of each picket in the inclined case can be cut at the appropriate angle, so that the angle between the top and bottom rail and the picket is equal to the end face angle cut on each of the picket ends to make each picket fit snugly within the channel.

A plurality of picket separating spacer plugs are used in the pedestrian railing construction to rigidly separate (at top and bottom) each vertical picket from an adjacent picket, and to hold the vertical pickets firmly in place. The spacer plugs are elongated, rigid, metal bars that are shaped in cross section to interlock and snap into each top and bottom railing bar channel.

A spacer plug has a cross-sectional shape and area (somewhat like an I-beam cross section) that is used to hold each bar picket in position laterally and is employed between each picket within the bar channel. Because of the spacer plug's unique cross-sectional shape, the spacer plug snaps snugly longitudinally into the top and bottom railing bar channels during the manufacture of the entire railing assembly when the pickets and spacer plugs are inserted. Once in place, each adjacent picket is separated rigidly by a separate snap-in spacer plug that is mounted in the top railing bar channel and the bottom railing bar channel. The spacer plug has end faces that are at a ninety degree angle to the longitudinal axis of the spacer plug when used in railings wherein the railing is mounted on flat ground representing the horizontal earth plane. In the situation where the entire railing is inclined at an angle relative to the earth's horizontal plane, such as a hill, the end face of each spacer plug may be angularly cut (not perpendicular) relative to the longitudinal axis of each spacer plug to accommodate the inclined angle so that the end face of each spacer plug fits snugly against the picket end portion in the bar channel that is used for the inclined environment. The cross-sectional shape of the space plug can be made to save the amount of metal used.

The ends of the pedestrian railing assembly are rigidly held together by vertical end bars that are welded to both the top and the bottom horizontal railing bars, once the pickets and spacer plugs are in place, adding tremendous rigidity to the entire rectangular structure. The last picket at each end of the entire guard railing structure is welded in place, top and bottom, to lock in the other pickets and spacer plugs.

A plurality of vertical support posts, which are preferably aluminum, are permanently attached to the ground in concrete pads and the top railing bar and the bottom railing bar. The posts are vertically disposed and placed apart as necessary and support the entire railing structure above the ground. The pickets can be arranged in a plumb line on an incline as are the support posts under certain hill conditions if required.

By using snap-in, rigid spacer plugs along with a plurality of pickets that all fit within top and bottom railing bar channels that project radially away from the periphery of the top bar and the bottom bar, the entire picket and railing bar assembly can be assembled and manufactured without welding each of the pickets individually to the top and bottom railing bars, except for the end pickets.

It is an object of this invention to provide an improved, aluminum pedestrian safety railing of increased strength and at reduced construction costs.

It is another object of this invention to provide an improved safety guard railing for use as a safety barrier along public walkways to protect pedestrian traffic and bicycle paths to protect cyclists that is non-complex to assemble, yet rigid in construction.

These and other important objects, advantages, and features of the invention will become clear as this description proceeds.

It is to be understood that both the foregoing general description and the following detailed description are explanatory and are not restrictive of the invention as claimed. The accompanying drawings, which are incorporated in and constitute part of the specification, illustrate embodiments of the present invention and together with the general description, serve to explain principles of the present invention.

DETAILED DESCRIPTION OF THE PREFERRED EMBODIMENT

Figure 1:
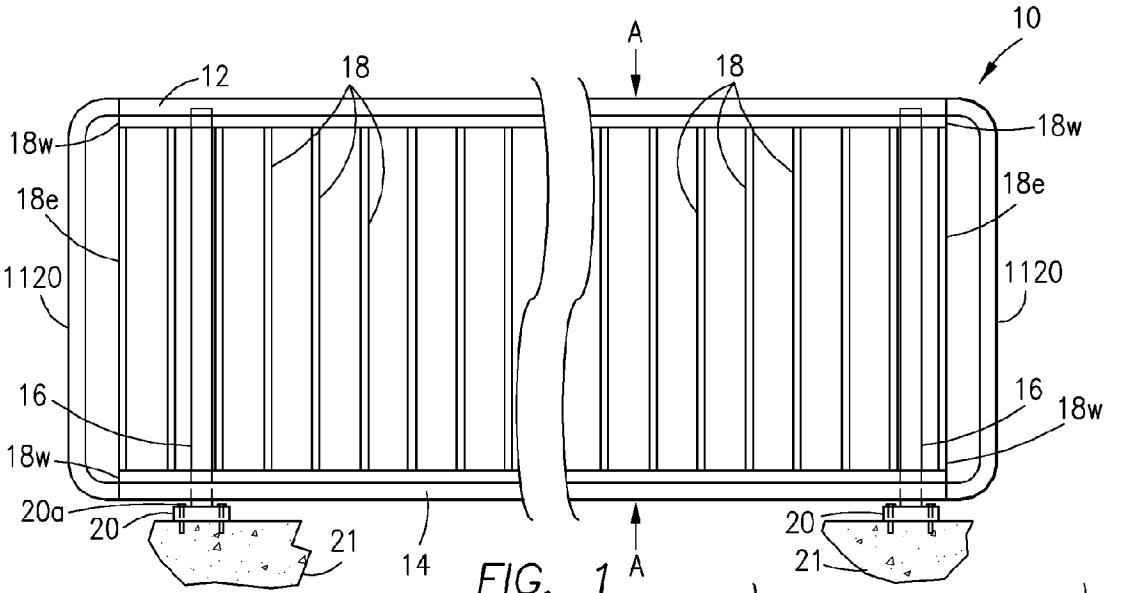
FIG. 1 shows a pedestrian and bicycle guard railing in accordance with the present invention, in a front elevational view.

Referring now to the drawings and in particular to FIG. 1, the present invention is shown as a pedestrian or bicycle guard railing 10 made of aluminum that is used particularly for pedestrian walkways or bicycle paths as a guard or barrier. The railing 10 may be made in any desired length depending on the particular environment. The guard railing 10 is typically firmly mounted and connected to concrete base 21 which may be a walkway or retaining wall. The railing 10 is anchored by rigid aluminum posts 16 mounted to aluminum plates 20 that are bolted with anchor bolts 20*a* into the concrete base 21. This allows the railing 10 to be anchored to the ground in a vertical, upright position and held firmly in place. The anchor bolts 20*a* (including anchor nuts) can be used to anchor the railing 10 into concrete base 21 with metal plate 20 that is rigidly attached to the railing post 16 described below. As shown in FIG. 1, two vertical aluminum posts 16 are used to rigidly support the railing 10 in a vertical position and attach the railing 10 firmly to concrete 21. The railing 10 is shown in FIG. 1 on level ground.

The railing 10 includes a top picket support bar 12 which is extruded aluminum and a bottom picket support bar 14 which is extruded aluminum, which can be made in indeterminate lengths or cut as desired and as explained herein. The top bar 12 and the bottom bar 14 are identical in cross-sectional shape, configuration and size. Top bar 12 and the bottom bar 14 each have identical cross-sectional areas and shapes that include a longitudinal passageway (see FIG. 4) disposed along a portion of the exterior surface (periphery) of each of the bars 12 and 14. In fact, the top bar 12 is the same bar for use as bottom bar 14. These bars 12 and 14 support a plurality of pickets 18.

A plurality of pickets 18 are rigid aluminum bars that are vertically positioned and mounted between the upper bar 12 and the lower bar 14, the picket ends within the longitudinal recessed channels of the upper bar 12 and the lower bar 14. When the railing 10 is mounted on level ground, the pickets 18 are perpendicular to top rail 12 and bottom rail 14 and each picket end faces are cut perpendicular to the picket longitudinal axis.

At each end of the railing 10, is a u-shaped curved, rigid aluminum bar 1120 that is welded at each end to top bar 12 and bottom bar 14. The end bars 1120 give rigidity to the entire structure. The end pickets 18*e* are welded at top and bottom at 18*w* to hold the spacer plugs and other pickets 18 in place.

Figure 2:
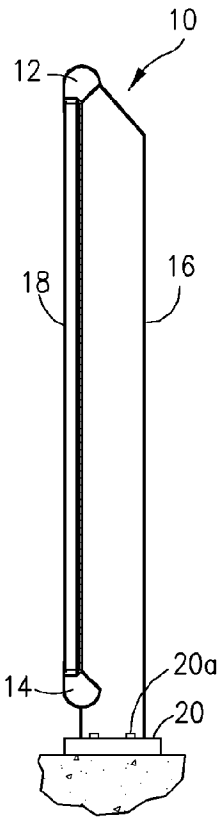
FIG. 2 shows a side elevational view in cross section through A—A of FIG. 1.

FIG. 2, a side view through line A—A of FIG. 1, shows one of at least two vertical posts 16 that supports the entire railing 10 above the ground and is anchored to the ground. The post 16 is connected (welded) to the upper bar 12 and the lower bar 14. The posts 16 are typically welded to the upper bar 12 and the lower bar 14 for rigidity and are spaced at regular intervals along the entire railing 10. The posts 16 act to support the entire structure vertically and anchor the railing 10 to concrete in the earth for permanency.

Figure 3:
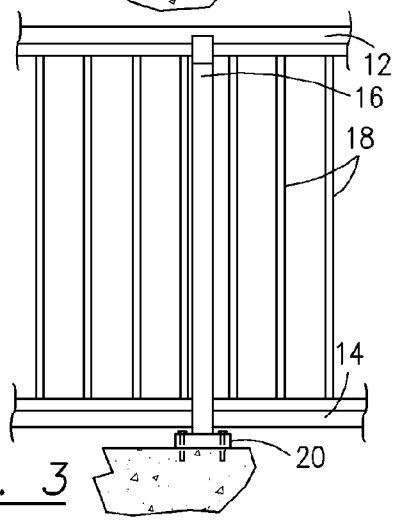
FIG. 3 shows a back elevational view partially cut away, of the railing post.

FIG. 3 shows the post 16 in relationship to upper bar 12 and lower bar 14 disposed on one side of the railing 10 on the opposite side as shown in FIG. 1.

Figure 4:
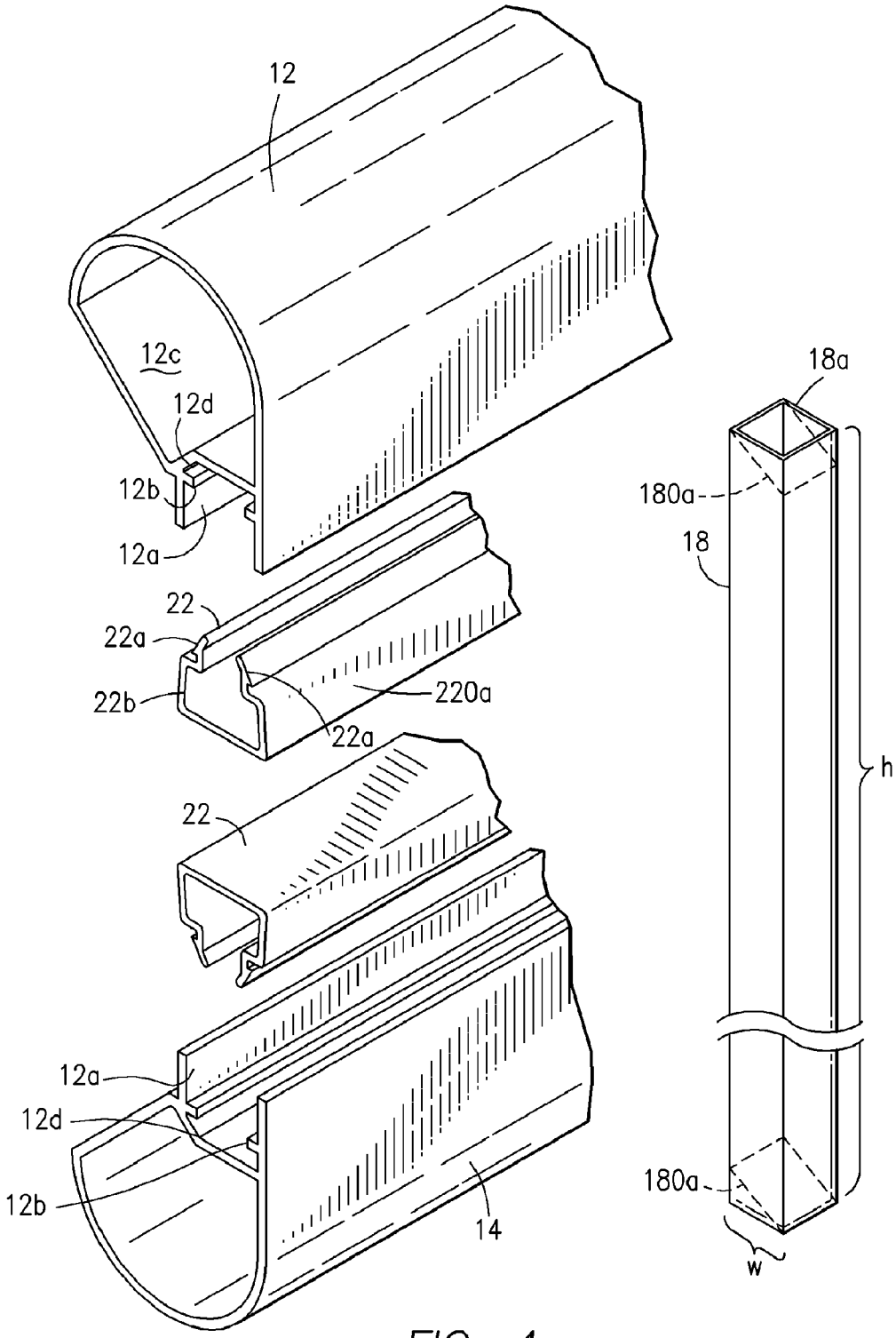
FIG. 4 shows a cutaway, exploded, perspective view of segments of the top and bottom bars, a picket, and top and bottom snap-in spacer plugs used in the present invention.

Referring now to FIG. 4, the structural relationship between the upper bar 12 and the identical lower bar 14 with respect to vertical pickets 18 is shown. The railing 10 is constructed by placing a plurality of pickets 18, which in this case happen to be rectangular in cross section, and sized in width "w" to fit as the same width of the bar channel 12*a* to fit snugly within the elongated channel 12*a* disposed in top bar 12. The channel 12*a* walls extend the entire length of each bar. Tabs 12*b* act as a stop for the upper end and lower end of each picket 18. The width "w" of each picket 18 is such that each picket fits snugly within passageway 12*a* in the elongated channel along the length of the extruded, aluminum bar 12. Note that because of the cross-sectional shape of the channel passageway and walls 12*a* and tabs 12*b* which project laterally and inwardly, the channel 12*a* can receive snap-in spacer plugs 22, (which are extruded aluminum bars of a predetermined length, which also snap snugly into the elongated channel 12*a*) that are used to separate and retain pickets 18 apart from each other. Bar 14 is used as the lower support bar in the railing 10 shown in FIG. 1 and also receives snap-in spacer plugs 22. The vertical pickets 18 can be spaced and held physically apart by a snap-in spacer plug 22 the length of which determines the fixed distance between adjacent pickets which may be inches or feet as desired. During manufacture and assembly of the railing 10, the snap-in spacer plugs 22 are manually snapped into the channel 12*a* and channel 14*a* and are positioned between each picket 18. The snap-in spacer plugs 22 can be extruded and cut in desired lengths or can be cut on site when the railing 10 is assembled. Pickets 18 can also be cut in desired lengths. The snap-in spacer plugs 22 have a unique cross-sectional configuration. The walls 22*b* form a u-shaped portion that snugly engages or fits within walls 12*a* in the outer channel and a pair of flanges 22*a* that fit in inner channel 12*d* formed by tabs 12*b* to interlock the snap-in spacer plug in the channel. The tabs 12*b* are tapered on their ends to facilitate engagement with the flanges 22*a* of the snap-in spacer plugs 22. Spacer plug flanges 22*a* are tapered and inclined from a center longitudinal axis off of the end portion of each spacer plug wall 22*b* to touch tabs 12*b* on the bottom for a snug fit while reducing the amount of aluminum material required by the tapered flange 22*a* construction. The snap-in construction of the spacer plugs renders the railing easier to install so that less labor is required to complete the task.

As shown in FIG. 1, it should be noted that once the railing 10 is assembled such that all the pickets 18 and snap-in spacer plugs 22 are in place, the end pickets 18*e* are welded at 18*w*, and the end bars 1120 are then welded at each end top and bottom to bars 12 and 14 forming an integral, rigid unit from which the spacer plugs 22 and pickets 18 can not be removed.

Figure 5A:
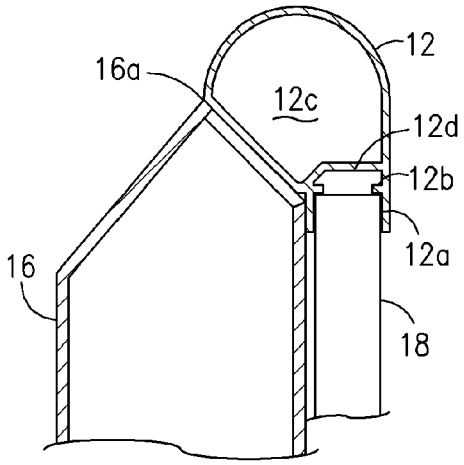
FIG. 5*a* shows a side elevational view in cross section of a post connected to the top bar in the present invention.
Figure 6:
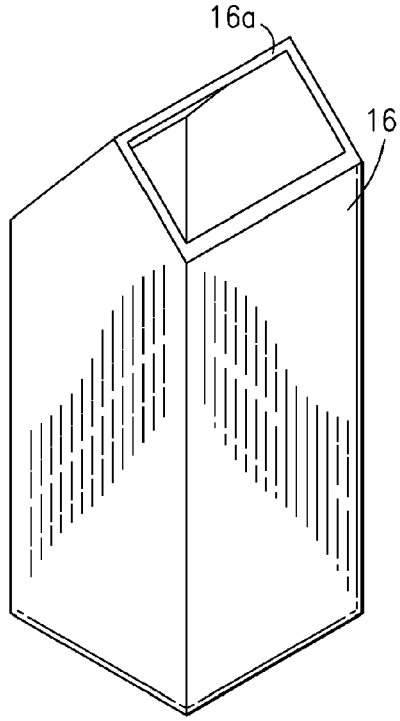
FIG. 6 shows the top end of a post in a perspective view without the top bar for connection of the present invention.
Figure 5B:
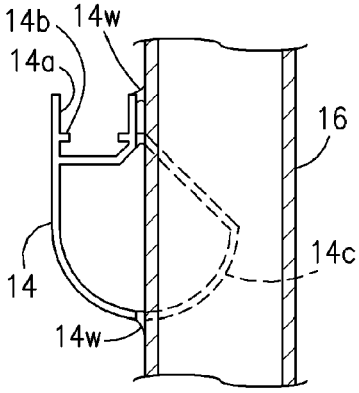
FIG. 5*b* shows a side elevational view in cross section of a post connected to the bottom bar in the present invention.

The anchoring posts 16 are welded to the top bar 12 as shown in FIGS. 5*a* and 6. FIG. 5*a* also shows how picket 18 fits within the passage 12*a* and the fact that post 16 is welded along 16*a* to firmly attach the upper bar 12 to the post 16. FIG. 6 shows the top portion of post 16 and the rectangularly shaped end face 16*a* that are formed in the upper portion in FIG. 6 of post 16 that engages a flat segment on the support bars 12 suitable for welding for attaching the bar 12 to the top portion of post 16 at end face 16*a*. FIG. 5*b* shows how the bottom bar 14 is attached typically to vertical post 16. The bottom bar 14 has a cut recessed portion 14*c*, which is a rectangular cutout portion from the bar 14 to allow the bar 14 to be welded along points 14*w* at the top and bottom of the bar to the post 16 exterior surface. This is different than the attachment to the top bar 12 to post 16 as shown in FIG. 5*a*. The vertical picket 18 end would fit within channel 14*a* along the bottom bar 14. By cutting out a rectangular segment along the length of bar 14 that fits the width of post 16, there is a snug fit in conjunction with the weld points 14*w* to rigidly hold the bar 14 and support the entire unit to post 16.

Figure 7:
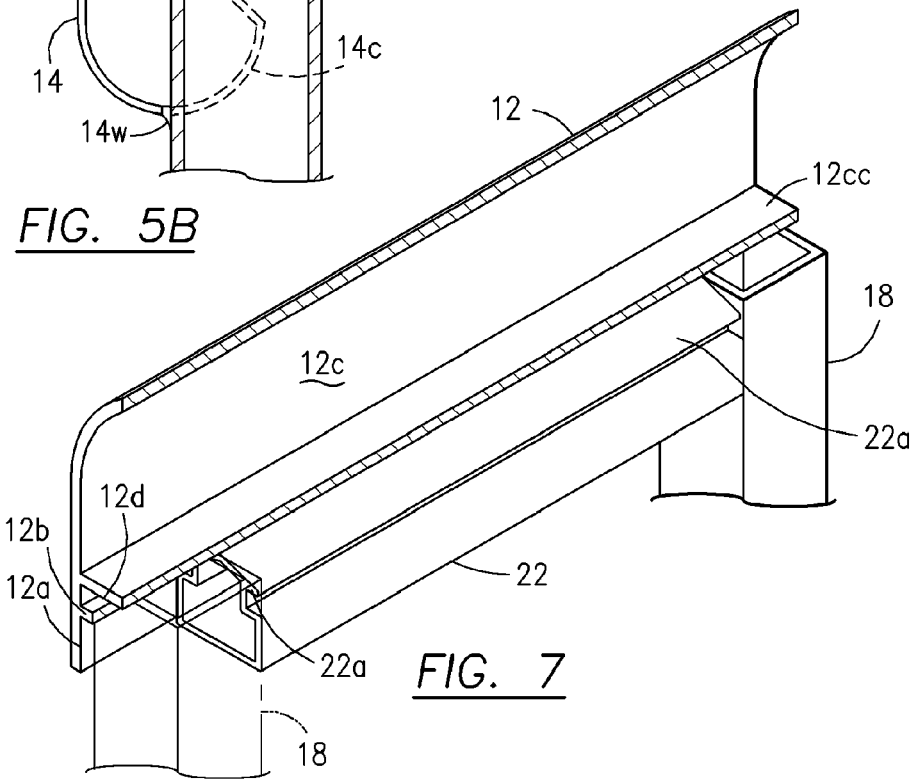
FIG. 7 shows a perspective view, partially cutaway, of the top bar, a picket and the spacer plug mounted in the top bar channel.

Referring now to FIG. 7, the snap-in spacer plug 22 is shown mounted between pickets 18 with respect to the upper bar 12 in a typical arrangement. The top and bottom ends of each of the pickets 18 fits in the lower portion of the passage 12*a* against the tabs 12*b*. The spacer plugs 22 fit snugly against each of the pickets 18 holding each picket firmly in place on each side. In this way, the pickets 18 cannot be removed from the railing. The snap-in spacer plugs 22 hold each picket 18 vertically and firmly in place at top and bottom. Note that there is no welding between the pickets 18 and the top bar 12 and the bottom bar 14 (except the outermost end pickets) and the spacer plugs 22. Spacer bar flange 22*a* engages tabs 12*b* and wall segment 12 cc that retains and interlocks snap-in spacer bar 22 in place in inner channel 12*d*.

The method of assembling the railing 10 without having to weld the pickets 18 to the top and bottom bars 12 and 14 while still maintaining the pickets 18 spaced apart rigidly in an integral unit greatly increases strength and reduces the cost of the manufacture of the railing while maintaining a rigid structure. The structural integrity of the railing and safety as a guard and barrier is not sacrificed in its construction. The perpendicular end faces of the pickets engage the top and bottom bar channel walls 12*cc* while the perpendicular end faces 22*a* of spacer plugs 22 engage the sides of pickets 18, firmly holding all of the pieces in place.

Figures 8A, 8B:
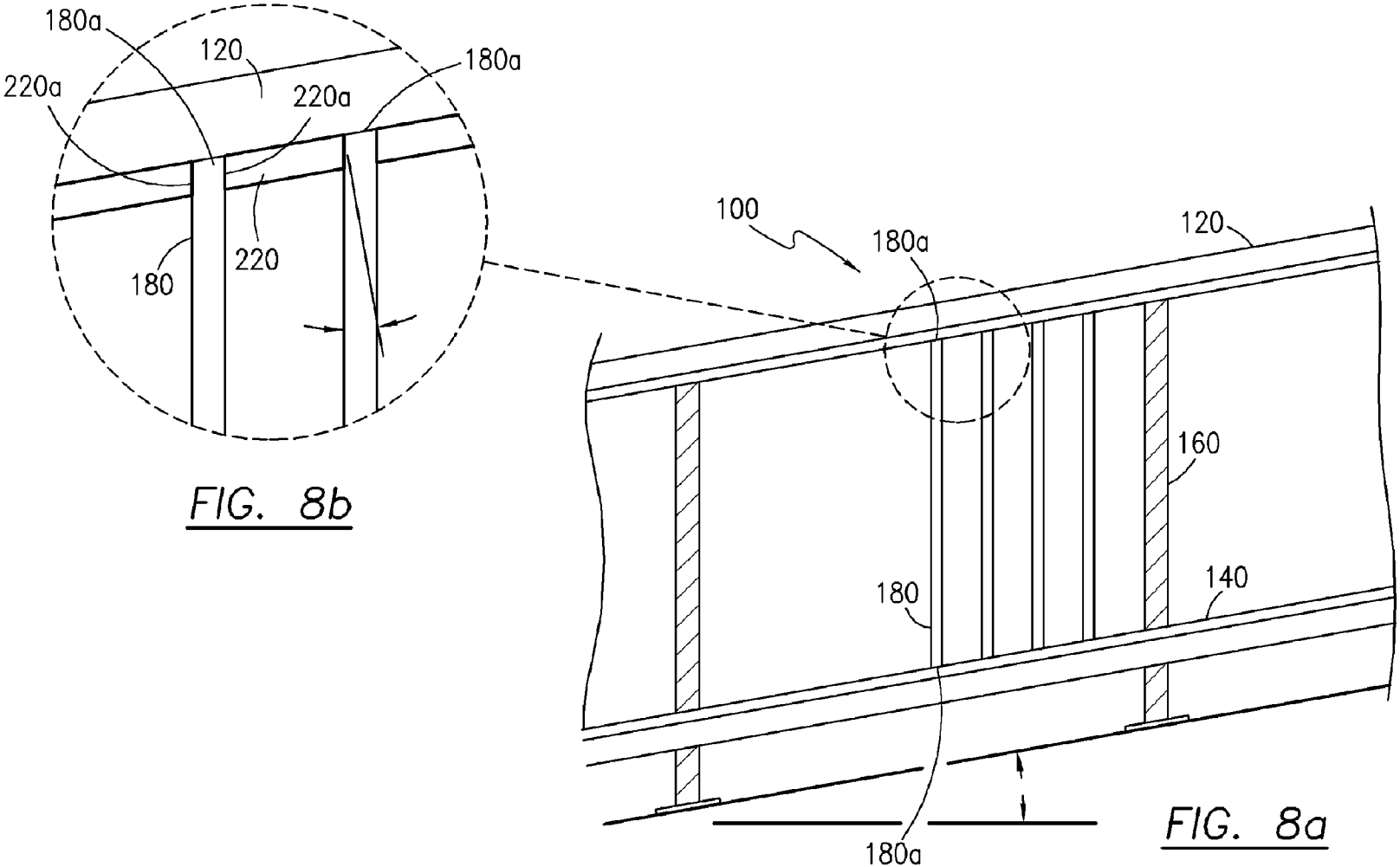
FIG. 8*a* shows a side elevational view, partially cut away (with some pickets deliberately left out for clarity) mounted on an inclined hill.
FIG. 8*b* is a side elevational view, partially cut away, showing a portion of the top rail as it is connected to at least two pickets and two spacer bars at an incline.

FIGS. 8*a* and 8*b* show an alternate embodiment of the invention. The railing 100 as shown in FIG. 8*a* is mounted on an earth incline relative to gravity and a plumb line (such as a hill) that may have an angle alpha relative to a flat (perpendicular to a plumb line) area. In this case the pickets 180 are mounted plumb vertically and parallel to the plumb vertical support posts 160 which would represent a plumb line relative to the ground. The configuration top support bar 120 and the bottom support bar 140 remain the same as shown in the preferred embodiment in FIGS. 1 through 7 in terms of their cross-sectional shape and the relationship between the spacer bars and the pickets. However, to ensure a snug fit on an incline, the ends of the pickets 180, the end face 180*a* and the bottom end face of the picket 180*a* must be angled to accommodate fitting snugly in the bar channel 120 for receiving the pickets. Also, spacer bars 220 have their end faces 220*a* cut at an angle alpha to properly engage the sides of each picket 180 for a flush engagement as shown in FIG. 8*a*. Thus in the method employed as shown in FIGS. 8*a* and 8*b*, once the angle of incline is determined, then the end faces 180*a* of the pickets 180 are cut at a similar angle so that the pickets fit in the top and bottom support bar 120 and 140 channels. Also the spacer plug end faces 220*a* are cut at the same angle that is necessary to ensure snug engagement against adjacent pickets 180 to keep them firmly in place. The spacer bar lengths can be individually cut in length of different lengths for a "custom fit" to space the pickets at different distances apart in the same railing.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A pedestrian and bicyclist safety railing comprising:

a rigid top hollow aluminum bar having a longitudinal, recessed channel protruding outwardly relative to the center of said bar, said bar channel having a predetermined cross-sectional configuration that includes a pair of passage tabs projecting laterally and inwardly forming upper and lower channel portions in said bar channel;

a bottom bar substantially identical to said top bar;

a plurality of elongated, rigid pickets having substantially a predetermined rectangular cross section, with the width of one dimension of said rectangle being sized for a snug fit into said lower bar channel portions of said top and bottom bars;

a plurality of snap-in spacer plugs having the same cross-sectional configuration as the cross-section of said bar channels including a pair of tapered flanges and a pair of recessed portions for receiving said passage tabs for holding and interlocking said spacer plug within said bar channel, said spacer plugs being sized in length to provide the desired distance apart between said pickets when in spaced engagement between adjacent pickets; and means for joining said top bar and said bottom bar in a parallel configuration with said plurality of pickets connected between said top bar and said bottom bar in a common plane, and spaced apart by a plurality of snap-in spacer plugs.

2. A safety railing as in claim 1, including:

said spacer plugs each being positioned between a pair of adjacent pickets and mounted within the top bar and the bottom bar, the end face of each spacer plug being substantially perpendicular to the longitudinal axis of each spacer plug for engaging in contact with the side wall of a picket for holding said picket in position.

3. A safety railing as in claim 1, including:

a first rigid post and a second rigid post welded to said top bar and said bottom bar; and means for anchoring said first post and said second post to a concrete anchor connected to said first post and said second post.

4. A safety railing as in claim 1, to eliminate the welding joints between the pickets and the top and bottom bars in the safety railing, said safety railing being constructed of aluminum.

* * * * *